United States Patent [19]

Dysart

[11] Patent Number: 4,688,651

[45] Date of Patent: Aug. 25, 1987

[54] CONE MOUTH DEBRIS EXCLUSION SHIELD

[75] Inventor: Theodore R. Dysart, Dallas, Tex.

[73] Assignee: Dresser Industries, Inc., Dallas, Tex.

[21] Appl. No.: 910,572

[22] Filed: Sep. 23, 1986

Related U.S. Application Data

[63] Continuation-in-part of Ser. No. 842,694, Mar. 21, 1986, abandoned.

[51] Int. Cl.[4] ..... E21B 10/22

[52] U.S. Cl. ..... 175/371; 175/337

[58] Field of Search ..... 175/371, 337

[56] References Cited

U.S. PATENT DOCUMENTS 1,641,261 9/1927 Fletcher ..... 175/371
2,260,487 10/1941 Scott ..... 175/371 X
3,921,735 11/1975 Dysart ..... 175/337
4,421,184 12/1983 Mullins ..... 175/337

FOREIGN PATENT DOCUMENTS 462014 1/1973 U.S.S.R. ..... 175/371

*Primary Examiner*—Stephen J. Novosad

[57] ABSTRACT

A rotary drill bit having a body with a projecting journal and a conical cutter having an axially recessed open end for receiving the journal wherein only the upper portion of the open cone mouth in the cavity formed between the cone and the body is shielded from drilled debris intrusion and the circulating air is channeled in the bearing to the bottom portion of the open cone mouth for improved flow pattern through the various bearing segments whereby the incidence of plugging of the bit due to excess formation being forced into the bearing at the gaping open portion of the upper cone mouth is reduced.

14 Claims, 8 Drawing Figures

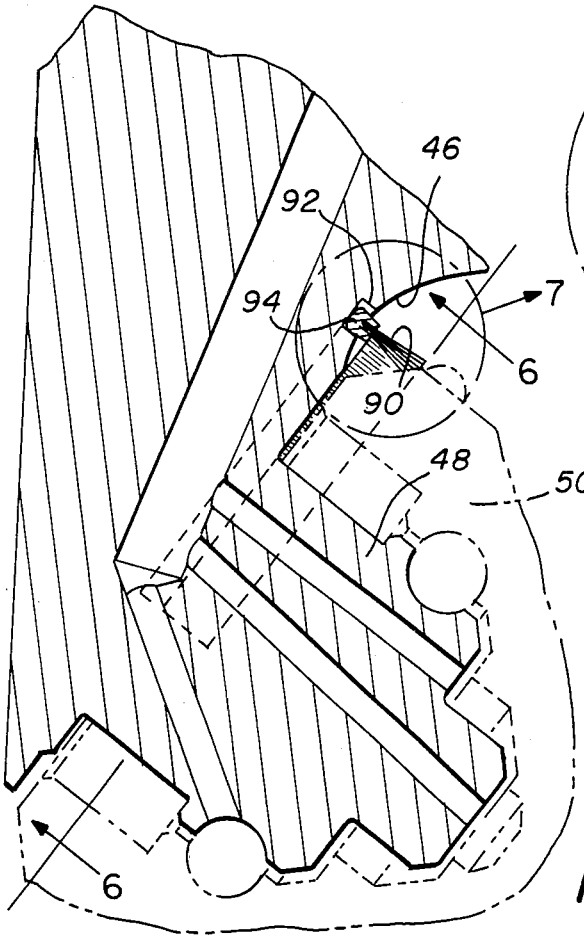
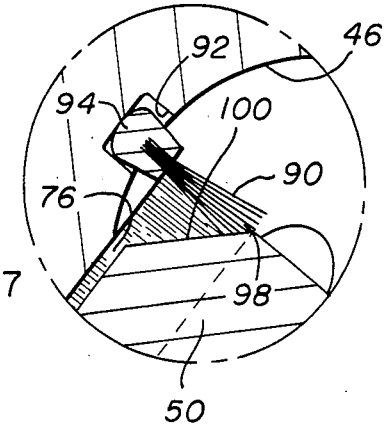
FIG. 7
FIG. 8
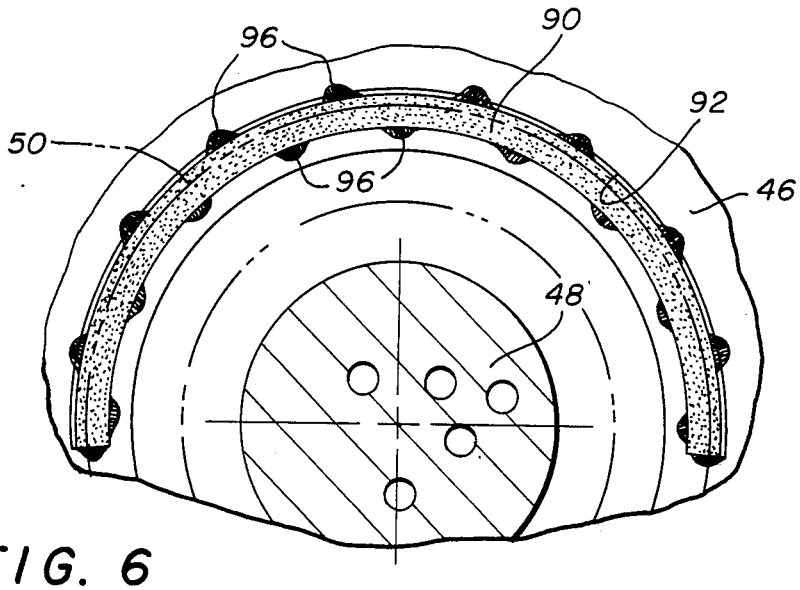
FIG. 6

CONE MOUTH DEBRIS EXCLUSION SHIELD

This application is a continuation-in-part application of Ser. No. 842,694, filed Mar. 21, 1986, entitled, CONE MOUTH DEBRIS EXCLUSION SHIELD, now abandoned.

BACKGROUND OF THE INVENTION

The present invention relates to a rotary drill bit having a body with a projecting journal and a conical cutter having an axially recessed open end for receiving the journal wherein only the upper portion of the open cone mouth in the cavity formed between the cone and the body is shielded from drilled debris intrusion and the circulating air is channeled in the bearing to the bottom portion of the open cone mouth for an improved flow pattern through the various bearing segments whereby the incidence of plugging of the bit due to excess debris being forced into the bearing at the gaping open portion of the upper cone mouth is reduced.

Conventional rock bits which are employed for drilling wells and the like ordinarily employ two or three or more cone shaped rolling cutters rotatably mounted on journals, the cutters having teeth or rock crushing inserts on their conical surfaces. The cutters are so arranged as to roll, under considerable weight, upon the bottom surface of the hole being drilled as the well string to which the bit is attached is rotated. The cutters are mounted on the journals by interior, anti-friction bearings which are highly subject to wear and destruction if abrasive debris at the bottom of the well is allowed to penetrate between the journal and the cutter so as to contact the bearings.

Various means have been employed to combat this problem. For instance, many of the prior art devices use a seal at the exposed juncture of the journal and the open cone mouth to prevent migration of contamination inwardly to the bearings and to seal in lubricants. However, in such a system, as the seals wear, contamination which does enter the space between the cutter and the journal may bypass the seal and create a more rapid wear and destruction of the cutter bearings.

Other systems utilize a compressed fluid, such as air, which is forced through the journal to the lower most inner portion of the cutter bit thus forcing the air or fluid upwardly and outwardly in the passageways between the journal and the interior of the cutter head where the bearings are located not only to cool the bearings but also to force any contamination which gets into the interior of the cutting bit through the passageways to the exterior of the cutter bit at the cone mouth.

However, because of the construction of the bits which are attached to the body journals, a space or cavity is formed between the body and the upper portion of the cone mouth and drilling materials forced into the cavity under pressure tend to block it so that the fluid on the interior of the cutter bit cannot force materials out the upper portion of the cone mouth thus allowing the debris that accumulates there to gradually work its way to the interior of the bit thereby destroying it.

The present invention shields or blocks only the upper portion of the open cone mouth from drilled muck intrusion. The shield is formed preferably of spring steel but could also be a brush with very stiff bristles, a semi-porous mesh or other material which resists crush and permanent set. In a preferred embodiment, an arcuate spring steel shield extends for approximately 180° about the journal and the cone mouth between the cone and the body in the upper semi-circle of the cone mouth and effectively blocks or prevents debris from entering this very vulnerable portion of the cone mouth. This blocking action is effected through the spring force of the shield which urges a curved portion of the shield against the rotating cone to block the space between the rotating cone and the body. In another embodiment, the contact of stiff brush bristles with the rotating cone is used to block the space between the rotating cone and the body. Thus, air, of other fluid which is forced through the journal to the interior of the cone, cannot exit at the upper portion of the cone mouth and therefore is forced to the lower portion and out there is less tendency for the muck to accumulate.

Thus, not only are the bearings effectively cooled and lubricated by the fluid but, by confining the exit area of the fluid to a limited area, the fluid pressure is also increased and the contamination is more effectively kept from entering the bearing. Further, the circulating air or fluid in the bearing which is forced to the bottom portion of the cone mouth provides for improved flow patterns through the various bearing segments and also reduces the incidence of plugging of the bit due to the excess formation being forced into the bearing at the gaping open portion of the upper cone mouth.

SUMMARY OF THE INVENTION

Thus, it is an object of the present invention to provide an improved rotary drill bit having body with a projecting journal, a conical cutter having an axially recessed open end for receiving the journal, interior anti-friction bearings in the cutter for rotatably mounting the cutter in spaced relationship with the journal, and a plurality of fluid passages in said journal extending to said bearings, the improvement comprising, a shoulder on the cutter in spaced relationship with the body and means for blocking only an arcuate portion of the space between the body and the shoulder to prevent debris from entering the space between the body and the shoulder and cause fluid to flow through the passageways around the bearings, said fluid being forced by the blocking means to exit the remaining open space between the body and the shoulder not blocked thereby preventing debris from entering the remaining open space and improving fluid flow about all the bearings.

It is also an object of the present invention to provide a method of reducing bearing wear in a rotary drill bit having a body with a projecting journal, a conical cutter having an axially recessed open end for receiving the journal, interior anti-friction bearings in the cutter for rotatably mounting the cutter in spaced relationship with the journal, and a plurality of fluid passages in the journal extending to the bearings, the improved method comprising the steps of forming a shoulder on the cutter in spaced relationship with the body, and blocking only an arcuate portion of the space between the body and the shoulder to prevent debris from entering the space between the shoulder and the body and cause fluid to flow through the passageways around the bearings, said fluid being forced to exit the remaining open space between the body and the shoulder not blocked thereby preventing debris from entering the remaining open space and improving fluid flow about all of the bearings.

BRIEF DESCRIPTION OF THE DRAWINGS

These and other objects of the present invention will be disclosed in conjunction with the accompanying drawings in which:

FIG. 6 is a cross-sectional view of the cutter and spindle of an alternative embodiment of the invention wherein the blocking means is a stiff bristled brush;

FIG. 7 is a cross-sectional view of the stiff bristled brush and the grooves in which it is positioned illustrating how the space between the cutter and the body is shielded; and FIG. 8 is a partial cross-sectional view of the journal and cutter illustrating how the brush is positioned to block the space between the cutter and the body.

DETAILED DESCRIPTION OF THE DRAWINGS

Figure 1:
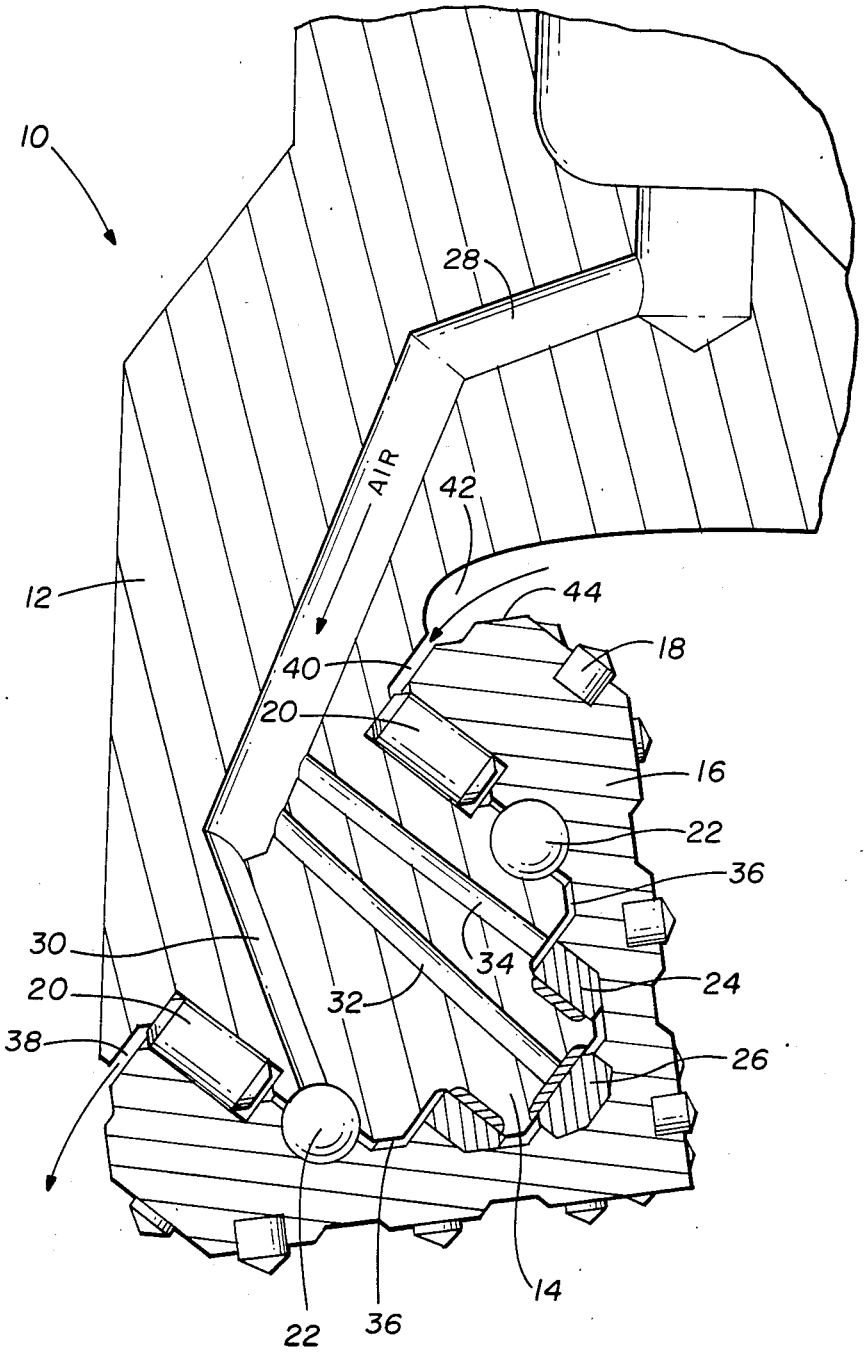
FIG. 1 is a partial cross-sectional view of a portion of a drilling bit illustrating the prior art.

FIG. 1 is a partial cross-sectional view of a prior art rotary cutting drill bit 10 having a plurality of legs, one leg 12 being shown with a journal 14 in cross-section and the cutter bit 16 in cross-section. It will be understood that body 10 has a plurality of depending legs but only one of which is shown as leg 12 for purposes of simplification. Extending downwardly and radially inwardly on the lower end of each of the legs such as leg 12 is a generally cylindrical spindle or journal 14. The cone shaped cutter 16 has suitable teeth 18 shown as a hard metal insert in the drawing and is rotatably mounted on journal 14. Suitable races are formed on the interior of cutter 16 and on the exterior of the journal 14 for roller bearings 20 and ball bearings 22. Pilot bushings 24 and thrust button 26 also carry a portion of the load between rotating cutter 16 and journal 14.

It is desirable that the bearings be adequately cooled due to the great heat that is generated in this area. Thus, a passageway 28 is provided for a fluid which extends through leg 12 and terminates in a plurality of passageways 30, 32 and 34 which penetrate through journal 14 and extend to the space 36 which exits between journal 14 and cutter 16 by virtue of the bearings 20, 22, 24 and 26 placed therein. The fluid in passageways 30, 32 and 34 is forced to the bottom and sides of the journal 14 thereby forcing the fluid through the spaces 36 around the appropriate bearings and out through the spaces 38 and 40 which exist between the upper rim of the conical space cutter 16 and the body or leg portion 12. It will be noted that a cavity 42 is formed between the body or leg portion 12 and the upper portion 44 of cone 16 by virtue of the configuration of leg 12 and conical cutter 16. Cavity 42 receives debris under intense pressure which tends to plug up the cavity 42 in spite of the fact that a fluid such as air is attempting to exit passage 40 under pressure. Once the debris solidly plugs up cavity 42, no fluid exits through gap or cone mouth 40 and thus the debris gradually works its way in through the gap 40 into the bearings 20 and 22 thus destroying the useful life of the cutter head.

Figure 2:
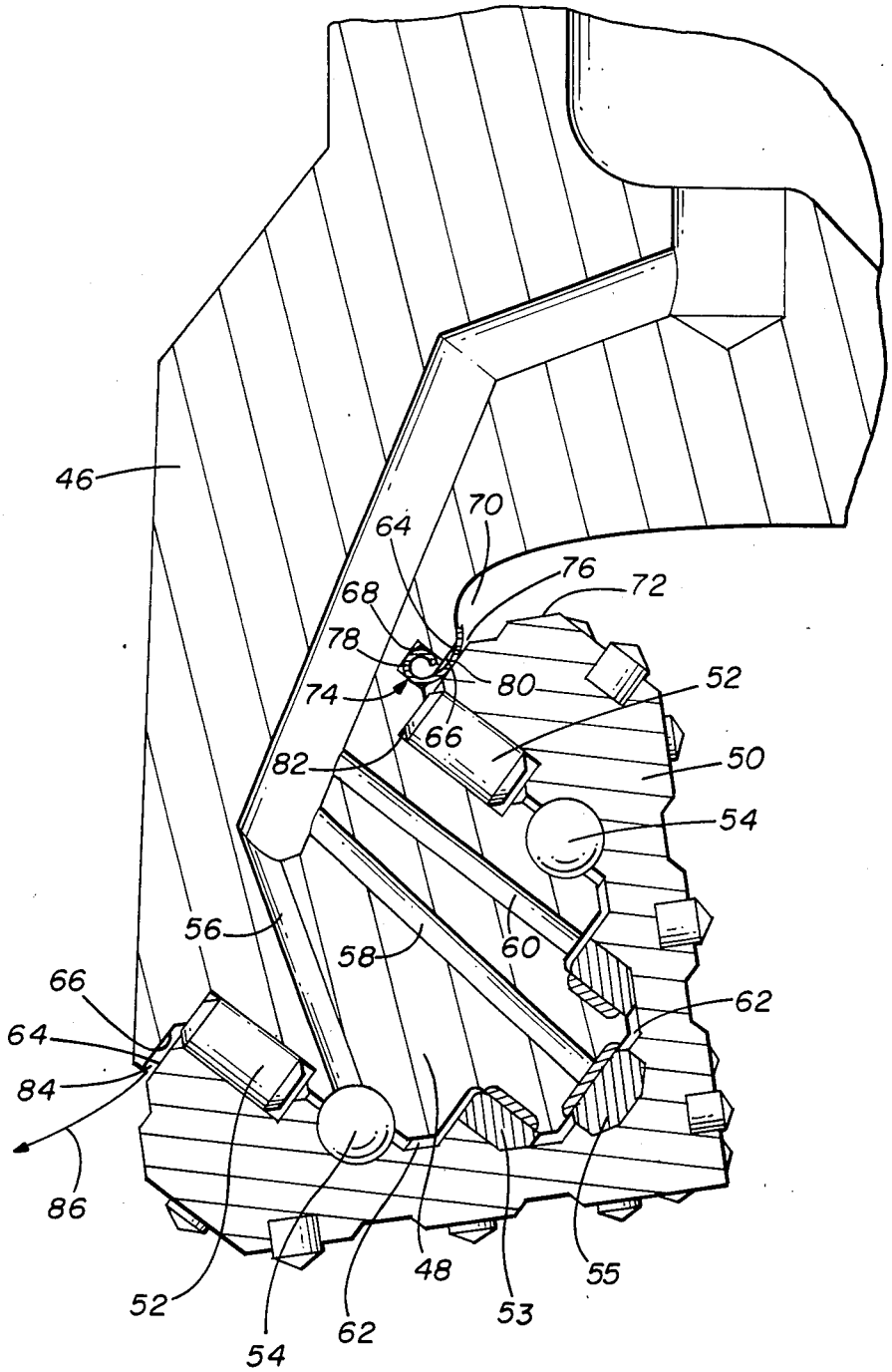
FIG. 2 is a partial cross-sectional view of a portion of a drilling bit illustrating the invention.
Figure 3:
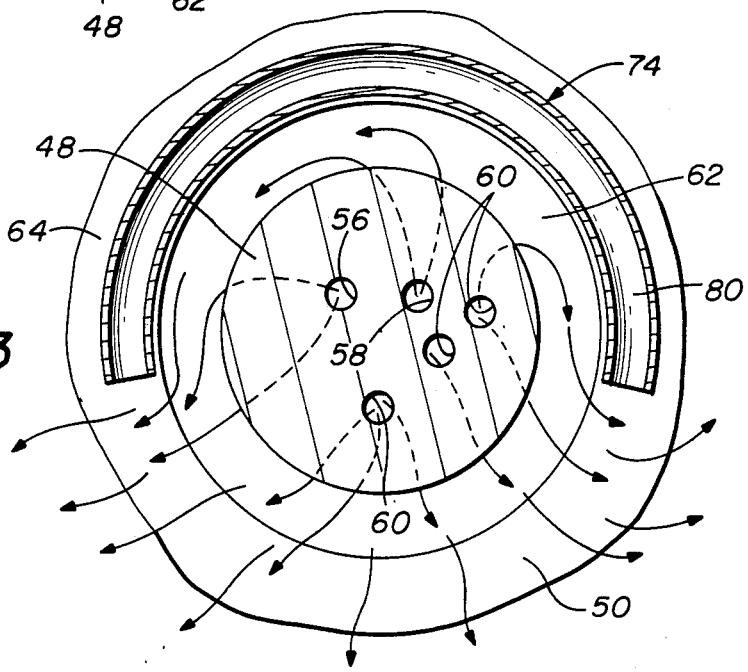
FIG. 3 is a cross-sectional view of the cutter and spindle on line 3—3 of FIG. 4.

FIG. 2 discloses the novel invention herein which prevents the debris in cavity 42 from entering the interior of the bearing. Again, as can be seen in FIG. 2, a drill body portion 46 has extending therefrom a journal 48 to which is attached the rotary cutting bit 50. The conical cutter head 50 has an axial recess which mates with and receives journal 48. Again, interior anti-friction bearings 52, 53, 54 and 55 rotatably mount the cutter 50 in spaced relationship with journal 48. Also, a plurality of fluid passages 56, 58 and 60 are formed in the journal 48 and extend to the bearings 52, 53, 54 and 55 and fluid circulates through the space 62 which exists between the interior of cone 50 and journal 48. A first flat shoulder 64 is formed on the outer rim of the conical cutter 50 and a second congruent flat shoulder 66 is formed on body 46 in spaced relationship with the first flat shoulder 64. An arcuate recess 68 is formed in flat shoulder 66 of body 46 only in the area of cavity 70 formed by the surface of body 46 and the adjacent arcuate recess 68 extends approximately 180° about journal 48 as shown in FIG. 3 but the exact length of the extension would depend upon the physical construction of the body 46. The important feature is to place the arcuate recess 68 in that portion of the body 46 which is adjacent cavity 70 formed between body 46 and cutter bit 50. Preferably a spring steel element 74 is used to shield the space 76 which exists between shoulder 64 and shoulder 66 although, as stated earlier, other materials which resist crushing and permanent set could be used. Shield 74 is a comma shaped structure with the large end 78 positioned in the recess 68 and an arcuate portion 80 extending into the space 76 between shoulders 64 and 66 to seal the space 76. Shield 74 is preferably formed of spring steel whereby the arcuate portion 80 may be deformed between the first and second shoulders 64 and 66 thereby expanding as the space 76 widens due to bearing wear and thus maintaining the shield in the space 76 as the space 76 increases or widens due to bearing wear.

As can be seen, any debris which accumulates in cavity 70 is effectively prevented from entering through passageway 76 by virtue of the shield 74 which is positioned therein. Thus, any fluid flow in passageways 56, 58 and 60 which tends to follow the space 62 on the upper portion of the journal 48 reaches shield 74 and cannot exit and thus travels downwardly through space 82 and exits the space 84 as indicated by arrow 86. Space 84 has a less tendency to be plugged with debris because it is in an open area rather than in a cavity such as cavity 70 formed by body 46 and rotary drill bit 50.

Figure 4:
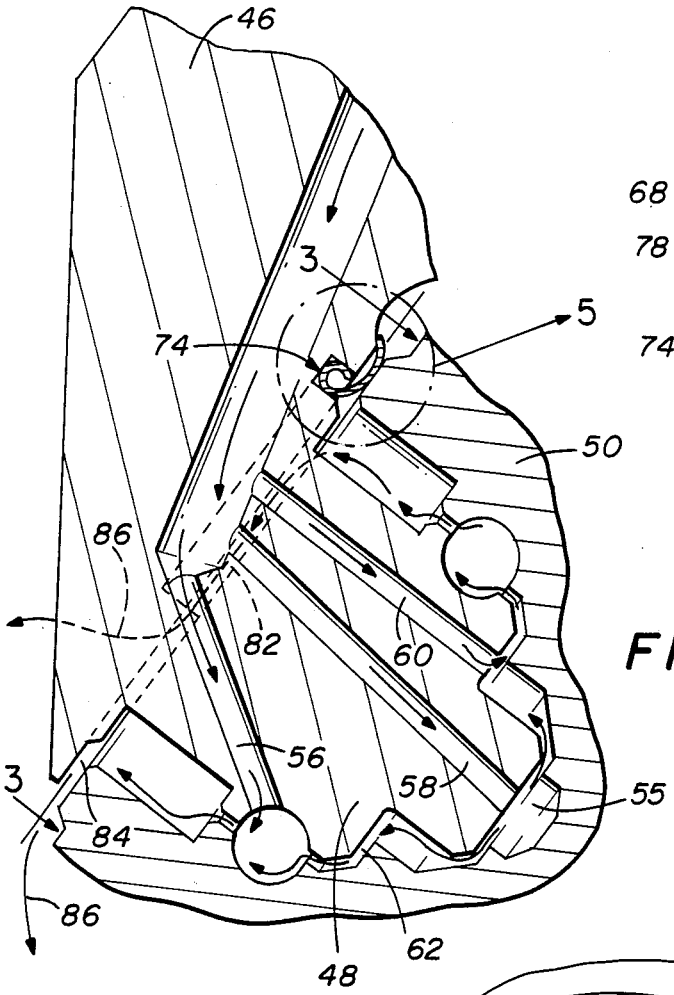
FIG. 4 is a partial cross-sectional view of the journal and bearing illustrating the air flow through the passages therein and being forced by the shield toward the opened portion of the lower cone mouth to exit therefrom.

FIG. 3 is a cross-sectional view taken along lines 3—3 of FIG. 4 and illustrates the various passageways 56, 58, and 60 in their respective relationship with shield 74. As can be seen in FIG. 3, the fluid tends to move towards shield 74 but then is forced down and out the space on the lower portion of the bit since it cannot exit where the shield 74 is located. This relationship tends to provide a better circulation of the fluid forcing it all the way to the bottom of the cone and up the passageways 62 along the bearings and then under greater pressure is forced out the remaining open space 84 (see FIG. 2 and FIG. 4) between the body portion journal 48 and the rotating cutting cone 50 thus providing for more effective prevention of debris from entering the bearings and for better cooling purposes.

As can be shown in FIG. 4, which is a cross-sectional view of the journal 48 illustrating the fluid flow about the periphery thereof around bearings 52 and 54 and up to shield 74 which prevents the fluid from exiting at that point and forcing it to travel through passageway 82 and exiting at 84.

Figure 5:
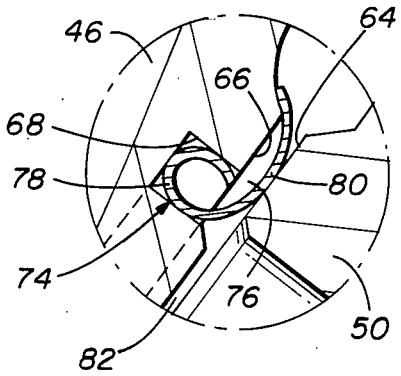
FIG. 5 is a cross-sectional view of the spring steel shield and the groove in which it is located and illustrating how the space between the rim of the cutter and the body is shielded.

FIG. 5 is a cross-sectional view of the novel spring steel shield 74 illustrating that it is generally comma shaped with a large portion 78 positioned in recess 68 and an arcuate portion 80 extending in space 76 to effectively block that space. As can be seen, the arcuate portion 80 is flexible since the material is made of spring steel and is deformed between shoulders 64 and 66. Thus, as the space 76 widens between the shoulders 64 and 66 due to wear of component parts, the spring can decompress or expand to continue to fill the space and allow the drilling bit to continue to fill the space and allow the drilling bit to continue functioning even though the bearings internally are wearing. Although the large portion 78 of the shield 74 is shown to be generally circular in shape, it could have other shapes such as a square shape to fit the square recess 68.

FIG. 6 is a cross-sectional view of the cutter spindle and body of an alternate embodiment of the invention which utilizes a stiff bristled brush to block the space between the rotating cutter and the body. The stiff bristled brush may be formed of any type of material including metal brushes or synthetic or natural materials. The primary concern is that the bristles be stiff to form a barrier to any debris which may attempt to enter the space between the rotating cutter mounted on spindle 48 and the body 46 yet the bristles should resist crushing and permanent set. The brush sits in a groove 92 formed in the body 46. It may be held in place by any well-known means such as a spring steel metallic holder 94 (See FIG. 7) or any other well-known type of mounting means such as shims 96 which wedge the brush tightly in groove 92.

As can be seen in FIG. 7 (which is a cross-sectional view of the stiff bristled brush in the groove in which it is positioned) the outer most end 98 of brush 90 resists against shoulder 100 of rotating cutter 50. Thus space 76 between the rotating cutter 50 and body 46 is blocked by the brush 98 thus preventing debris from entering therein. As necessary, when brush 90 wears sufficiently that it no longer blocks the debris from entering space 76, the brush may be removed and replaced.

As can be seen in FIG. 8 brush 90 extends partially about the circumference of the rotating cutter bit only in the area of space 76 in order to block it and to effectively prevent debris from entering therein and for causing air being circulated through the bearings to exit the remaining open space between the body and the cutter which is not blocked by the brush thereby improving fluid flow about all of the bearings as well as preventing debris from entering the remaining open space.

Thus, there has been disclosed a novel cone mouth debris exclusion shield which shields the upper portion of the open cone mouth from drilled muck intrusion, has channels for circulating fluid to the bottom portion of the cone mouth for improved flow pattern through the various bearing segments and reduces the incidence of plugging of the bit due to excess formation material being forced into the bearing at the gaping open portion of space between the flat shoulder on the upper cone mouth and the flat shoulder, on the body. Further, because the shield extends for approximately 180° around the flat shoulder 66 forming the cone mouth between the cone 50 and the body 46 in the upper semicircle of the cone mouth it effectively shields this very vulnerable portion of the cone mouth. The shielding action is effected through either a stiff bristled brush or the spring force of a comma shaped shield which urges the curved shielding portion against the rotating cone mouth. Of course, the shield may be located either in the flat shoulder of the body or the flat shoulder on the rim of the cutter.

While the invention has been described in connection with a preferred embodiment, it is not intended to limit the scope of the invention to the particular form set forth, but, on the contrary, it is intended to cover such alternatives, modifications and equivalents as may be included within the spirit and scope of the invention as defined by the appended claims.

We claim:

1. In a rotating drill bit having a body with a projecting journal, a conical cutter having an axially extending recess open at one end for receiving said journal, interior anti-friction bearings in said cutter for rotatably mounting said cutter on said journal in spaced relationship with said journal, and a plurality of fluid carrying passages in said journal extending to said bearings, said fluid exiting said recess through said open end, the improvement comprising:

a. a shoulder on said cutter in spaced relationship with said body, and b. blocking means in resilient abutting relationship between said cutter and said body for closing an arcuate portion of said space between said body and said shoulder on the upper side of said journal to prevent debris from entering the open end of said cutter through said space between said shoulder and said body on the upper side of said journal and said fluid is forced to exit the open end from the remaining open space between said body and said shoulder not closed by said blocking means thereby preventing debris from entering said open space.

2. The improved drilling bit of claim 1 further comprising:

a. a cavity formed between one portion of said body and said conical cutter on the upper side of said journal when said cutter is mounted on said journal, and b. means for locating said blocking means on said body for closing said space between said cutter shoulder and said body on the upper side of said journal in the area of said cavity whereby any debris collected in said cavity is prevented from entering said blocked space between said cutter shoulder and said body.

3. An improved drilling bit as in claim 2 further including:

a. an arcuate recess in said body in the area of said cavity and b. a steel shield positioned in said recess in contact with said cutter shoulder as said blocking means for closing said space between said body and said shoulder and preventing debris from entering therein.

4. An improved drilling bit as in claim 3 wherein said shield comprises:

a. a substantially, comma shaped structure having a large end and an arcuate portion, b. the large end of said structure being positioned in said recess, and c. the arcuate portion of said structure extending into said space between said body and said shoulder to close said space in the area of said cavity.

5. An improved drilling bit as in claim 4 wherein said shield is formed of spring steel whereby said arcuate portion of said structure may be deformed between said body and said cutter shoulder thereby expanding as said space widens due to bearing wear to maintain said shield in said space.

6. An improved drilling bit as in claim 2 further including:

a. an arcuate recess in said body in the area of said cavity, and b. a stiff bristled brush positioned in said recess in contact with said cutter shoulder as said blocking means for closing said space between said body and said shoulder in the area of said cavity and preventing debris from entering therein.

7. An improved drilling bit as in claim 6 wherein said recess is located in said cavity and said brush bristles are of such a length so as to make contact with said rotatable cutter thereby closing said space between said body and said shoulder on the upper side of said journal in the area of said cavity.

8. A method of reducing bearing wear in a rotary drill bit having a body with a projecting journal, a conical cutter having an axially extending recess open at one end for receiving said journal, interior anti-friction bearings in said cutter for rotatably mounting said cutter in spaced relationship with said journal, forming a cavity between one portion of said body and said conical cutter on the upper side of said journal by mounting said cutter on said journal and a plurality of fluid carrying passages in said journal extending to said bearings, said fluid exiting said recess through said open end, said method comprising the steps of:

a. forming a shoulder on said cutter in spaced relationship with said body, and b. locating blocking means in resilient abutting relationship between said cutter and said body for closing an arcuate portion of said space between said body and said shoulder on the upper side of said journal to prevent debris from entering the open end of said cutter through said space between said shoulder and said body on the upper side of said journal and said fluid is forced to exit the open end from the remaining open space between said body and said cutter shoulder not closed by said blocking means thereby preventing debris from entering said open end through said remaining open space.

9. The improved method of claim 8 further comprising the step of locating said blocking means on said body for closing said space between said cutter shoulder and said body on the upper side of said journal in the area of said cavity whereby debris collected in said cavity is prevented from entering said open end of said cutter through said blocked space between said cutter shoulder and said body.

10. The method of claim 9 further including the steps of:

a. forming an arcuate recess in said body in the area of said cavity, and b. positioning a steel shield in said recess in contact with said cutter shoulder as said blocking means for closing said space between said body and said shoulder in the area of said cavity and preventing debris from entering therein.

11. The method of claim 10 further including the steps of:

a. forming said shield generally in the shape of a comma having a large end and an arcuate portion, b. positioning the large end of said shield in said recess, and c. extending the arcuate portion of said shield into said space between said body and said shoulder to close said space in the area of said cavity.

12. The method of claim 11 further including the step of forming said shield of spring steel whereby said arcuate portion of said shield may be deformed between said body and said shoulder thereby expanding as said space widens due to bearing wear to maintain said shield in said space.

13. A method as in claim 9 further comprising the steps of:

a. forming an arcuate recess in said body in the area of said cavity, and b. positioning a stiff bristled brush in said recess in contact with said cutter shoulder as said blocking means for closing said space between said body and said shoulder in the area of said cavity and preventing debris from entering therein.

14. A method of claim 13 further including the steps of:

a. locating said recess in said cavity, and b. forming said brush bristles of such a length so as to make contact with said shoulder of said rotatable cutter thereby closing said space between said body and said shoulder on the upper side of said journal in the area of said cavity.

* * * * *